United States Patent [19]

Sane et al.

[11] Patent Number: 4,544,457

[45] Date of Patent: Oct. 1, 1985

[54] DIMENSIONALLY STABLE DRAINED ALUMINUM ELECTROWINNING CATHODE METHOD AND APPARATUS

[75] Inventors: Ajit Y. Sane, Willoughby; Douglas J. Wheeler, Cleveland Heights, both of Ohio; Charles S. Kuivila, Evanston, Ill.

[73] Assignee: Eltech Systems Corporation, Baca Raton, Fla.

[21] Appl. No.: 505,229

[22] Filed: Jun. 17, 1983

Related U.S. Application Data

[63] Continuation-in-part of Ser. No. 376,628, May 10, 1982, abandoned.

[51] Int. Cl.[4] ..... C25C 3/06; C25C 3/08; C25B 11/03; C25B 11/04

[52] U.S. Cl. ..... 204/67; 204/243 R; 204/283; 204/284; 204/290 R; 204/291; 204/293; 204/294

[58] Field of Search ..... 204/67, 283, 284, 290 R, 204/293, 291, 292, 243 M-247, 294

[56] References Cited

U.S. PATENT DOCUMENTS

| | | | |
|---|---|---|---|
| 2,959,533 | 11/1960 | De Varda | 204/67 |
| 3,028,324 | 4/1962 | Ransley | 204/67 |
| 3,492,208 | 1/1970 | Seager | 204/67 |
| 3,856,650 | 12/1974 | Kugler | 204/243 R |
| 4,093,524 | 6/1978 | Payne | 204/67 |
| 4,177,128 | 12/1979 | Rahn | 204/243 R |
| 4,219,391 | 8/1980 | Foster | 204/67 |
| 4,231,853 | 11/1980 | Rahn | 204/243 R |
| 4,410,403 | 10/1983 | Jacobs et al. | 204/67 |
| 4,443,313 | 4/1984 | Gesing et al. | 204/243 R X |

FOREIGN PATENT DOCUMENTS

| | | |
|---|---|---|
| 0069502 | 1/1983 | European Pat. Off. . |
| WO83/01465 | 4/1983 | PCT Int'l Appl. . |
| 362531 | 6/1962 | Switzerland . |
| 1068801 | 5/1967 | United Kingdom . |

*Primary Examiner*—Donald R. Valentine
*Attorney, Agent, or Firm*—John J. Freer

[57] ABSTRACT

A method and apparatus for making a drained aluminum electrowinning cathode dimensionally stable. A thin, ½ to 10 millimeter coating of substantially stagnant molten aluminum is maintained upon the cathode surface by an openly porous sheath or membrane closely conforming to contours of the electrowinning cathode. The sheath or membrane is made from a material substantially resistant to corrosives present in the aluminum electrowinning; it may be only slightly aluminum wettable, but should be relatively electrically nonconductive.

17 Claims, 4 Drawing Figures

DIMENSIONALLY STABLE DRAINED ALUMINUM ELECTROWINNING CATHODE METHOD AND APPARATUS

This is a continuation-in-part of application Ser. No. 376,628, filed May 10, 1982, and now abandoned.

TECHNICAL FIELD

This invention relates to electrowinning of aluminum, particularly from cryolite and specifically to dimensionally stable electrodes for electrowinning aluminum and methods for their making.

BACKGROUND OF THE INVENTION

Aluminum is commonly produced by the electrolysis of $Al_2O_3$ at about 900° C. to 1000° C. Aluminum oxide being electrolyzed is generally dissolved in molten $Na_3AlF_6$ (cryolite) that generally contains additives helpful to the electrolytic process such as $CaF_2$, $AlF_3$ and LiF.

In the electrolytic cell, reduction of the aluminum oxide occurs at a cathode generally positioned upon the bottom or floor of the electrolytic cell. Oxygen is liberated from electrochemically disassociating $Al_2O_3$, and in commercial cells, generally combines with carbonacious material comprising the cell anode and is emitted from the cell as CO and $CO_2$.

In many commercial cells, the cathode is comprised of a material relatively resistant to corrosive effects of contents of the cell such as cryolite. This cathode often covers substantially the entire floor of the cell which typically can be 6 feet wide by 18 or more feet in length.

Molten aluminum is a substance relatively resistant to corrosive and solvating effects in an aluminum electrowinning cell. In utilizing aluminum for cathode purposes in a cell, typically the cathode is an assembly including a cathodic current feeder covered by a pool of aluminum ranging in depth, depending upon the cell, from a few inches to in excess of a foot. The aluminum pool functions effectively as a cathode and also serves to protect current feeders made from materials less than fully resistant to cell contents. For example, unprotected graphite used as a cathode can generate aluminum carbide an undesirable contaminant, while when used as a covered current feeder, no such contamination results.

These pool type cell cathode assemblies contain conductive current collectors. Where these conductive current collectors are utilized in some cell configurations, these collectors contribute to an electrical current flow within the cell that is not perpendicular to the cell bottom. These nonperpendicular electrical currents can interact with strong electromagnetic fields established around cells by current flow through busses and the like contributing to strong electromagnetic fluxes within the cell.

In cells employing a pool of aluminum covering the cathode floor of the cell, the cryolite, containing the $Al_2O_3$ to be electrolyzed, floats atop this aluminum pool. The cell anodes are immersed in this cryolite layer.

It is important that these anodes do not contact the aluminum pool, for such contact would result in a somewhat dysfunctional short circuit within the cell. The electromagnetic flux within the cell contributes to the formation of wave motion within the aluminum pool contained in the cell, making prediction of the exact depth of the aluminum pool, and therefore the minimum necessary spacing between the anode and cathode current collector and between the anode and the interface between aluminum and cryolite at any particular cell location somewhat imprecise. Therefore, cell anodes are positioned within the cryolite to be substantially above the normal or expected level of the interface between cryolite and aluminum within the cell.

The combination of a substantial aluminum pool depth and a positioning of the anodes above the cryolite-aluminum normal interface position to forestall short circuits triggered, for example, by wave motion in the aluminum that would locally alter the aluminum pool depth, establishes a substantial gap between the anode and cathode in most conventional cells. A portion of the electrical power consumed in operation of the cell is somewhat proportional to the magnitude of this gap. Substantial reductions in the magnitude of this gap would result in considerable cost savings via reduced cell electrical power consumption during operation.

In one proposal, a packing or filler material is introduced into the cell, generally to a depth normally occupied by the aluminum pool. The packing tends to break up wave motion within the cell making prediction of the position of the interface between the aluminum pool and the cryolite more predictable. Where the interface position is more reliable, the anodes can be positioned somewhat closer to the interface, promoting incrementally reduced power consumption.

In such packed cells, however, the anode and cathode remain separated by a depth of cryolite, sufficient to forestall short circuits caused by localized disruptions in the aluminum pool depth existing notwithstanding the packing. This separation can lead to a large electrical power inefficiency in operating the aluminum electrowinning cell. Further, materials used for packing the cell must be substantially resistant to corrosive effects of cell contents. Such materials often are costly, and therefore packing the large numbers of these spacious electrolytic cells necessary for producing aluminum can be economically burdensome.

Another proposed solution has been to employ so-called drained cathodes in constructing aluminum electrolysis cells. In such cells, no pool of aluminum is maintained upon a cathode current feeder to function as a cathode; aluminum drains from the cathode as it forms to be recovered from a collection area. In drained cathode cells, without wave action problems attendant to the aluminum pool, the anode and the cathode may be quite closely arranged, realizing significant electrical power savings.

In these drained cathode cells, however, the cathode or vulnerable cathodic current feeder often is in generally continuous contact with molten cryolite. This aggressive material, in contact with a graphite or carbon cathode, contributes to material losses from the cathode as well as the formation of aluminum carbides, a dysfunctional impurity. Carbon or graphite for use as a drained cathode material of construction is therefore of quite limited utility due to service life constraints.

Other longer lived materials are, in theory, availabe for use in a drained cathode. Generally these materials are both conductive and aluminum wettable refractory materials such as $TiB_2$. It has been found that unless $TiB_2$ and similar materials are in essentially pure form, they too lose material or corrode at unacceptable rates in the aggressive cell environment. It is believed that the molten cryolite contributes to $TiB_2$ corrosion by fluxing reaction products of $TiB_2$ and aluminum generated near grain boundaries of the material. While it is known that essentially pure $TiB_2$ does not exhibit in aluminum electrowinning cells as substantial a corrosion susceptibility as does lower purity $TiB_2$, cost and availability factors seriously limit the use of $TiB_2$ sufficiently pure to withstand the aggressive cell environment.

DISCLOSURE OF THE INVENTION

Now, therefore, it is an object of the present invention to provide an economical improved drained cathode for aluminum electrolysis, substantially dimensionally stable, when used in an aluminum electrolysis cell.

It is a further object of the present invention to provide a method for making an aluminum electrolysis cell drained cathode to be dimensionally stable during aluminum electrolysis.

It is a still further object of the present invention to provide a cathode configuration permitting relatively close anode and cathode spacing, thereby permitting realization of substantial electrical power savings.

The improved cathode of the present invention presents an electrically conductive surface to aluminum being electrowon thereon from molten cryolite contained within the cell. The improvement comprises a sheath or membrane conforming closely to the presented electrowinning surface. The sheath or membrane at least covers those portions of the electrowinning surface upon which aluminum is being electrowon. The sheath or membrane is porous or apertured. This porosity is open, that is the apertures extend from one sheath or membrane surface through a thickness of the sheath to the other so as to form continuous fluid pathways between the surfaces. These pores or apertures are of a size and configuration whereby aluminum is retained therein during electrolysis, in contact with the cathode presented surface but substantially stagnant within the pores or apertures.

The sheath or membrane is formed from a material substantially resistant to corrosion by contents of the aluminum electrolysis cell. It is preferred that the sheath or membrane be relatively nonelectrically conductive. It is desirable but not essential that the sheath or membrane be somewhat wettable by the molten aluminum being retained within the pores and thereby substantially coating the cathode with a film of aluminum.

A drained cathode used for aluminum electrowinning is therefore rendered relatively dimensionally stable by providing a substantially stagnant coating of molten aluminum upon the surface of such a cathode presented for the electrowinning process. In preferred embodiments, this coating or film retained upon the cathode electrowinning surface is not less than about 0.5 millimeter and not greater than about 10.0 millimeters. Aluminum depositing upon the cathode in a depth greater than the sheath thickness continues to drain from the cathode surface to be recovered.

A drained cathode structure results from the practice of the instant invention. Aluminum being electrolyzed fills the porous sheath thereby protecting the cathode substantially from contact with cryolite contained within the cell by providing a substantially stagnant aluminum coating upon the cathode. The cathode is rendered less subject to corrosion and therefore substantially dimensionally stable. Yet a narrow separation between anode and cathode within the cell can be maintained since substantial wave motion within the relatively thin aluminum coating provided upon the cathode by the sheath is unlikely.

In another aspect of the invention, the drained electrowinning surface of a refractory hard metal boride, nitride, carbide or mixtures or combinations thereof has molten aluminum retained in substantially stagnant contact therewith by at least one piece of a substantially non-electrically conductive material selected from $Si_3N_4$, BN, AlON, SiAlON, AlN and $AlB_{12}$. This material can either be an apertured sheath, as described previously, or could be made up of several discrete pieces of any suitable shape which are so arranged as to leave spaces in which the molten aluminum is retained in stagnant contact with the electrowinning surface.

The above and other features and advantages of the invention will become apparent from the following detailed description of the invention along with the drawings of the invention and examples accompanying the detailed description, all forming a part of the specification.

BEST EMBODIMENT OF THE INVENTION

Figure 1:
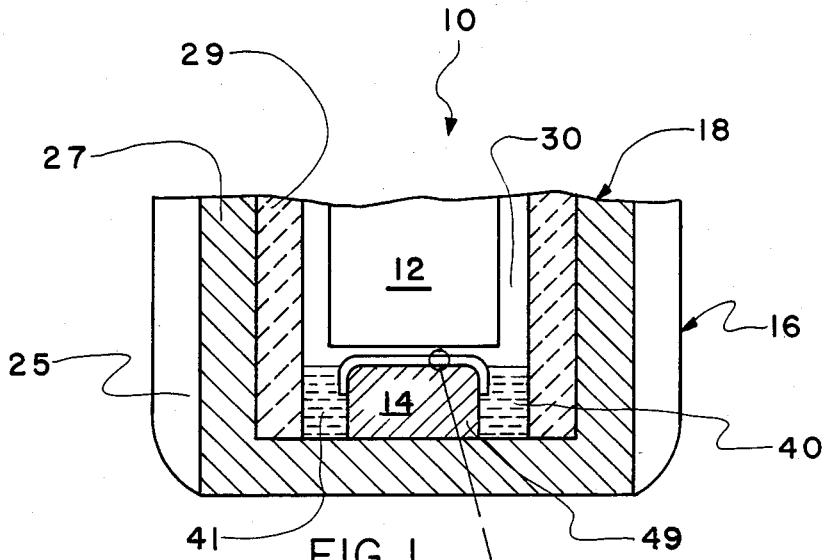
FIG. 1 is a cross-sectional view taken transversely of an aluminum electrolysis cell embodying the invention.

The present invention provides a drained cathode structure for use in an aluminum electrolysis cell. The drained cathode is substantially dimensionally stable. Referring to the drawings, an aluminum electrolysis cell 10 is shown generally in FIG. 1. The cell 10 includes an anode 12 and a cathode 14 contained within a housing 16 that includes a liner assembly 18.

The housing 16 includes a shell 25 usually made from a suitable or conventional substance like steel. Contained within the housing 16 is a liner assembly 18 that includes a layer 27 that generally resists aggressive attack upon the shell 25 by contents of the cell such as cryolite. In this best embodiment, the layer 27 functions also as a current conductor for supplying electrical current to the cathode 14. In equally preferred embodiments, this layer 27 can include embedded current conductors (not shown) for supplying electrical current to the cathode 14. Refractory materials and graphite are suitable for fabricating this layer 27, as are other suitable or conventional materials.

An insulating layer 29 is provided to resist heat flow from the cell 10. While a variety of well-known structures are available for making this insulating structure, commonly the insulating layer 29 is crystallized contents of the electrolytic cell.

The anode 12 is fabricated from any suitable or conventional material and immersed in a cryolite phase 30 contained in the cell. Since oxygen ions react at the anode, the material must be either resistant to attack by oxygen or should be made of a material that can be agreeably consumed by the oxygen. Typically carbon or graphite is utilized. The anode 12 should be arranged for vertical movement within the cell so that a desired spacing can be maintained between the anode and cathode notwithstanding the anode being consumed by evolved oxygen.

Figure 2:
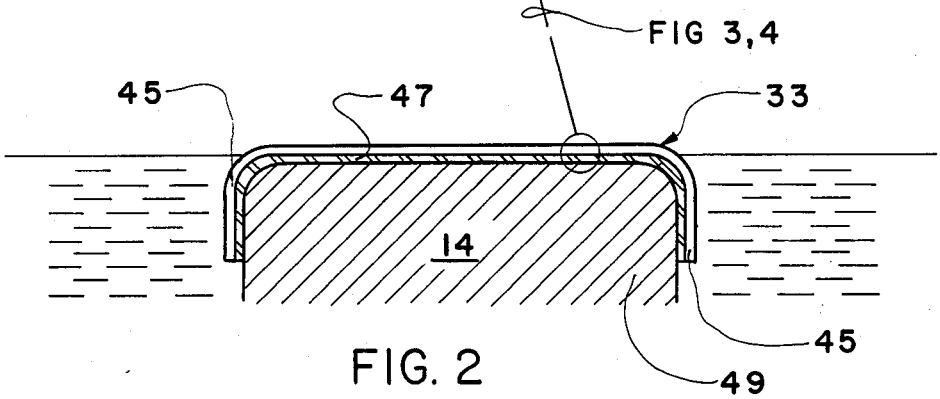
FIG. 2 is an expanded view of a cathode shown in FIG. 1.
Figure 3:
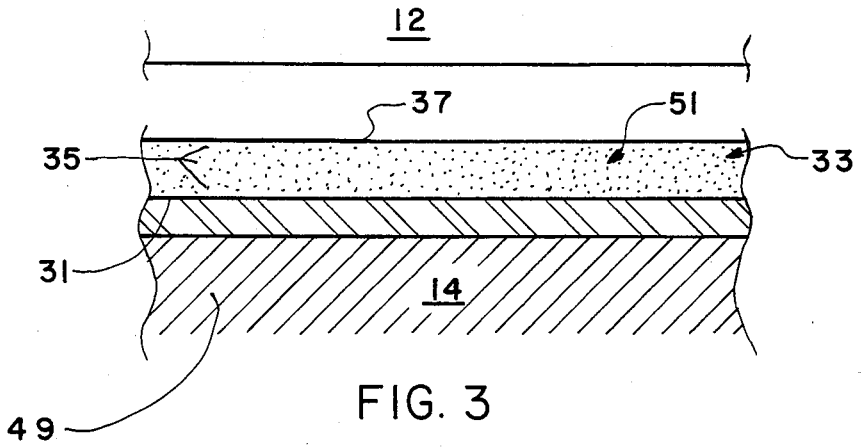
FIG. 3 is an elevational cross-section of a cell portion immediately adjacent the aluminum electrolysis surface of the cathode showing a sheath configuration.
Figure 4:
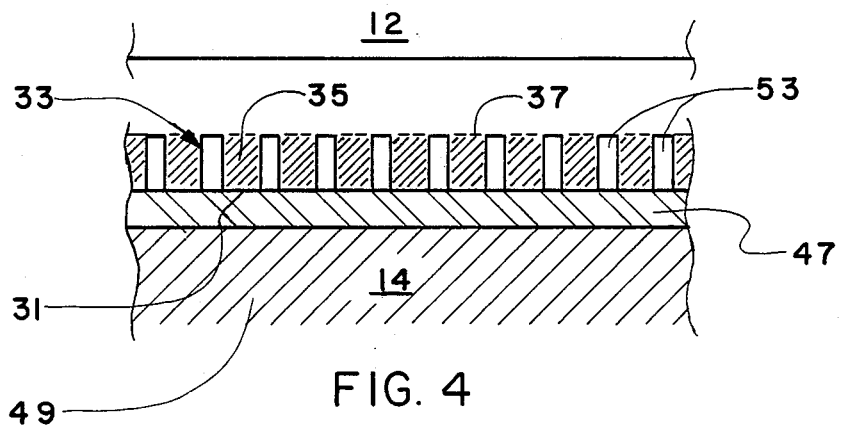
FIG. 4 is an elevational cross-section of a cell portion immediately adjacent the aluminum electrolysis surface of the cathode showing an alternate sheath configuration.

The cathode 14 is mounted in the cell in electrical contact with the conductive liner 27 or with conductors contained within the liner. Referring to FIGS. 2, 3 and 4, it may be seen that the cathode has a surface 31 for electrolyzing aluminum. This surface is covered by a sheath 33 or membrane having apertures 35 or being openly porous. The porosity should communicate through the thickness of the sheath 33 so that aluminum being formed by electrolysis fills the apertures 35 or pores. Once filled, the aluminum in the pores remains substantially stagnant with further electrolysis occurring not on the presented surface 31 but upon a surface 37 defined by the filled porous sheath 33. Aluminum forming at this surface drains away to recovery areas 40, 41 from which it is removed. Aluminum is maintained in the recovery areas 40,41 to a depth necessary to insure immersion of edge portions 45 of the sheath 33.

By coating in this manner, the substance of the cathode is shielded from contact with cryolite. Once shielded from the cryolite, a variety of materials can be used in making the cathode that would otherwise be undesirable due to elevated material losses in the aggressive cell environment.

Desirably, refractory metal borides, carbides and nitrides are thereby rendered suitable for use in fabricating drained cathodes. For purposes of this invention, particularly of use are borides, carbides and nitrides of: titanium; zirconium; niobium; tungsten; tantalum; molybdenum; silicon; as well as mixtures thereof. Titanium boride of at least 97.5 percent purity and $TiB_2$ composited with other of the refractory metal boride carbides and nitrides are most preferred. While these materials can be prohibitively expensive where consumed or corroded at a significant rate in an aluminum cell, once under a thin protective aluminum coating, they may be employed for electrolyzing for extended periods with little material losses. Any cathode surface selected should be both electrically conductive and at least significantly aluminum wettable.

In an equally preferred alternate to the best embodiment, the cathode includes a refractory metal boride, nitride, or carbide layer 47 applied to a suitable or conventional electrically conductive substrate 49 such as graphite. Where the refractory layer 47 is $TiB_2$ and is protected by maintaining an aluminum film or coating on the $TiB_2$ surface using the sheath 33 or membrane, a particularly advantageous, substantially dimensionally stable cathode structure results.

Since when using a drained cathode structure, no pool of aluminum exists in which wave motion might cause a short between anode and cathode, the anode and cathode can be positioned closely opposing each other. This close positioning permits cell operation at a reduced cell voltage, the anode being positioned in molten cryolite only a short distance from the sheathed cathode upon which molten aluminum is being electrolytically generated.

The sheath 33 or membrane can be of any suitable or conventional construction having a plurality of pores or apertures traversing its thickness. The precise configuration can be an openly porous rigid foam 51, a single layer honeycomb structure, an interconnected cellular structure, or a bar and grid arrangement 53 to name a few, depending upon the material of construction. The pores or apertures form interstices in the sheath that fill with molten aluminum during electrolysis to coat the cathode surface 31.

The sheath 33 or membrane may be formed from any suitable or conventional material substantially inert to aggressive chemical attack in the cell environment. Electrical conductivity is not requisite. Preferably the material used for the sheath will be at least slightly wettable by aluminum to assist in filling interstices in the sheath with molten aluminum. Particularly useful for making the sheath or membrane are: $Si_3N_4$, BN, AlON, SiAlON, $AlB_{12}$, AlN, $TiB_2$, and combinations thereof.

The sizing of pores 35 or apertures within the sheath 33 or membrane is critical to effective implementation of the instant invention. The sheath or membrane should substantially infiltrate with molten aluminum so that the molten aluminum forms a continuous electrical current pathway between the surface 31 of the cathode and cryolite phase 30 surrounding the sheath. Yet aluminum filling the sheath or membrane interstices should remain substantially stagnant avoiding circulation leading to significant contact between the molten cryolite phase 30 and the cathode surface 31. Since areas of the cathode 14, below the aluminum liquid and in the recovery areas 40, 41 do not contribute substantially to aluminum electrowinning, they are not sheathed.

The thickness of the sheath should preferably be such as to hold a thickness of between about 0.5 millimeter to about 10.0 millimeters of molten aluminum substantially stagnant upon the cathode surface 31. Most preferably, this thickness is between 1.0 and 2.5 millimeters.

Desirable cross-sectional dimensions of individual pores or apertures by necessity vary widely as a function of aluminum, cryolite and sheath material interfacial tensions. Generally the more aluminum wettable the sheath material, the smaller the pores may be made, and the less wettable by aluminum the sheath material, the larger the pores may be in cross-section. The wide variance in these traits from one sheath material to another requires individual determination of acceptable pore sizes for each sheath material of construction and cryolite phase formulation. Generally a suitable pore will be found having dimensions, other than depth, between about 25 microns and 5000 microns. It is to be expected that the thickness of the sheath 33 will impact upon the desirable pore or aperture 35 cross-sectional dimension.

The following examples are offered to further illustrate the features and advantages of the invention.

EXAMPLE 1

Two aluminum electrolysis cells are assembled in accordance with FIG. 1 and the best embodiment of the invention. A $TiB_2$ tile of 99+ percent purity is used to form the refractory layer 47, adhered to a graphite substrate 49, thereby forming the cell cathode 14. A sheath of grid configuration as shown in FIG. 4 is placed upon the electrolyzing surface 31 of the cathode in one of the cells. The sheath is a plate $34.9 \times 12.4 \times 2.3$ millimeters drilled to include a plurality of 2.6 millimeter diameter apertures. The sheath or grid is formed from BN. The cells are filled with cryolite having the composition (percent by weight)

$Na_3AlF_6$: 79.5%
$Al_2O_3$: 10.0%
$CaF_2$: 6.8%
$AlF_3$: 3.7% and electrolysis is commenced using a cell voltage of between about 2.98–3.27 volts D.C. at a current density of 0.5 amperes per square centimeter of cathode surface. Anode-cathode spacing is about 2.5 centimeters.

After 10 operating hours, the cells are shut down and the $TiB_2$ tiles checked for material losses. The tile from the cell having sheath protection providing a layer of aluminum on the refractory layer 47 surface 31 is found to have a layer of 7 mils or less in thickness in which grain boundry corrosion was observed, whereas the tile from the unprotected cathode is found to have suffered grain boundry type corrosion losses of between 25 and 30 microns in thickness. In the cell having a protected cathode current efficiency during aluminum electrolysis was found to be 66.8 percent, this efficiency customarily being substantially greater when applied to commercial scale cells. The aluminum produced in the cell was found to be contaminated with 65 parts per million titanium.

EXAMPLE 2

Cells identical to those of Example 1 are assembled and operated for 100 hours before being shut down for evaluation of tile corrosion. The protected cathode is found to have suffered between 5 and 11 microns corrosion of the $TiB_2$ refractory layer 27, the unprotected cathode between 26 and 40 microns.

While a preferred embodiment has been described in detail, it will be apparent that various modifications and alterations may be made thereto without departing from the scope of the appended claims. Particularly a great variety of drained cathode cell configurations are conceivable deriving substantial benefit from sheathed configuration providing a protective layer of molten aluminum upon the electrolysis surface 31, the subject of the instant invention.

What is claimed is:

1. In an electrolysis cell for electrowinning aluminum having a cathode presenting a drained electrically conductive electrowinning surface to contents of the cell, the improvement comprising:

a sheath closely conforming to contours of the presented surface at least where the presented surface contacts aluminum being electrowon;

the sheath having a plurality of apertures traversing a sheath thickness, the apertures being of a size and configuration whereby molten aluminum is retained within the apertures during electrolysis remaining substantially stagnant and in contact with the presented surface; the sheath being made of a material substantially resistant to corrosion by contents of the electrolysis cell.

2. In the electrolysis cell of claim 1, the electrically conductive electrowinning surface being made from a material selected from refractory metal borides, nitrides, carbides, carbon and mixtures thereof, the improvement comprising additionally:

the sheath being made of material selected from a group consisting of $Si_3N_4$, BN, AlON, SiAlON, AlN, $TiB_2$, and mixtures thereof.

3. In the electrolysis cell of claim 1, the electrically conductive electrowinning surface being $TiB_2$; the improvement comprising additionally:

the sheath being made of material selected from a group consisting of $Si_3N_4$, BN, AlON, SiAlON, AlN, $TiB_2$, and mixtures thereof.

4. The improved cell of any of claims 1, 2 or 3, the apertures having no dimension other than depth smaller than 25 microns nor larger than 5000 microns.

5. The improved cell of any of claims 1, 2 or 3, the sheath being between about 0.5 and 10.0 millimeters in thickness.

6. The improved cell of any of claims 1, 2 or 3, the sheath being between 1.0 and 2.5 millimeters in thickness.

7. A method for making a drained aluminum electrowinning cathode surface dimensionally stable comprising the steps of:

sheathing said surface in close conformance to contours of the cathode surface at least where such surface contacts aluminum being electrowon, said sheath having a plurality of apertures traversing the sheath thickness, the apertures being of size and configuration whereby molten aluminum is retained within the apertures during electrolysis; and electrolyzing a composition for electrowinning aluminum in contact with the resulting sheath surface; thereby providing a coating including substantially stagnant molten aluminum upon the cathode.

8. The method of claim 7 wherein the stagnant coating is between about 0.5 and 10.0 millimeters in thickness.

9. A method for making a drained aluminum electrowinning cathode surface made from one of carbon, and refractory metal carbides, nitrides and borides dimensionally stable, comprising the steps of:

sheathing said surface in close conformance to contours of the cathode surface at least where such surface contacts aluminum being electrowon, said sheath having a plurality of apertures traversing the sheath thickness, the apertures being of size and configuration whereby molten aluminum is retained within the apertures during electrolysis; and electrolyzing a composition for electrowinning aluminum in contact with the resulting sheath surface; thereby providing a coating including substantially stagnant molten aluminum upon the cathode surface of at least about 0.5 millimeter in thickness, but not more than 10.0 millimeters.

10. A method for making an aluminum electrowinning cathode surface made from $TiB_2$ dimensionally stable, comprising the steps of:

sheathing said surface in close conformance to contours of the cathode surface at least where such surface contacts aluminum being electrowon, said sheath having a plurality of apertures traversing the sheath thickness, the apertures being of size and configuration whereby molten aluminum is retained within the apertures during electrolysis; and electrolizing a composition for electrowinning aluminum in contact with the resulting sheath surface; thereby providing a coating including essentially stagnant molten aluminum upon the cathode surface of at least about 0.5 millimeter in thickness, and not more than 10.0 millimeters in thickness.

11. The method of any of claims 8, 9 or 10 wherein the coating is between about 0.5 and 2.5 millimeters in thickness.

12. In an electrode presenting a drained electrically conductive electrowinning surface for use in an electrolysis cell used to electrowin aluminum, the improvement comprising:

an openly porous membrane closely conforming to contours of the presented surface at least where the presented surface is in contact with aluminum being electrowon, pores within the membrane being of a size and shape whereby molten aluminum is retained in the pores during electrolysis substantially stagnant and in contact with the presented surface, the membrane being substantially resistant to corrosive effects of contents of the electrolysis cell.

13. In the electrode of claim 12, the electrically conductive electrowinning surface being of a material selected from a group consisting of carbon and refractory metal borides, carbides, and nitrides, the improvement comprising additionally:

the membrane being of a material selected from a group consisting of $Si_3N_4$, BN, AlON, SiAlON, AlN, $TiB_2$, and mixtures thereof.

14. In the electrode of claim 12, the electrowinning surface being made of $TiB_2$, the improvement comprising additionally:

the membrane being made from a material selected from a group consisting of $Si_3N_4$, BN, AlON, SiAlON, AlN, $TiB_2$, and mixtures thereof.

15. The electrode of any of claims 12, 13 or 14, the pores having no dimension other than depth smaller than 25 microns nor larger than 5000 microns.

16. The electrode of any of claims 12, 13 or 14, the membrane being between about 0.5 millimeter and about 10.0 millimeters in thickness.

17. An aluminum electrowinning cell having a drained electrowinning surface of a refractory hard metal boride, nitride, carbide or mixtures or combinations thereof, the electrowinning surface having molten aluminum retained in substantially stagnant contact therewith by at least one piece of a substantially non-electrically conductive material selected from $Si_3N_4$, BN, AlON, SiAlON, AlN and $AlB_{12}$.

* * * * *